United States Patent [19]

Bergsten

[11] Patent Number: 4,697,669

[45] Date of Patent: Oct. 6, 1987

[54] FOLDING PORTABLE TREE STEP

[76] Inventor: Arvid H. Bergsten, Box 34, Anoka, Minn. 55303

[21] Appl. No.: 4,057

[22] Filed: Jan. 16, 1987

[51] Int. Cl.[4] ..... A63B 27/00; A63B 29/04

[52] U.S. Cl. ..... 182/92; 182/189; 248/216.1

[58] Field of Search ..... 182/92, 91, 90, 228, 182/189, 100; 248/216.1, 217.1; 108/152

[56] References Cited

U.S. PATENT DOCUMENTS

| | | | |
|---|---|---|---|
| 3,298,459 | 1/1967 | Bergsten | 182/92 |
| 3,380,697 | 4/1968 | Melcher | 182/92 |
| 3,498,409 | 3/1970 | Meyer | 182/92 |
| 4,413,706 | 11/1983 | Michael | 182/92 |
| 4,415,061 | 11/1983 | Meyer | 182/92 |
| 4,449,612 | 5/1984 | Southard | 182/92 |
| 4,620,610 | 11/1986 | Southard | 182/92 |

*Primary Examiner*—Reinaldo P. Machado
*Attorney, Agent, or Firm*—Kinney & Lange

[57] ABSTRACT

A folding portable tree step includes a channel-shape support leg pivotally mounted at a bottom portion to a channel-shape foot member so that when the two are folded for storage purposes, both channel members are open in the same direction. A special lag screw with a square head is pivotally and slidably mounted to an upper portion of the support arm, and a lag screw pivot pin slidably mounts the screw into cam-like guides provided in the channel legs of the support leg. When the lag screw extends outwardly from the support leg and the folded foot member, and the screw pivot pin is in the lower portion of the guide slot, the head of the lag screw is held by the web of the support leg channel so that the lag screw will not pivot when being initially driven into a tree. When the lag screw is moved longitudinally with respect to the support leg, the pivot pin moves the square screw head away from the support leg channel web, and the screw can be pivoted with respect to the support leg.

10 Claims, 9 Drawing Figures

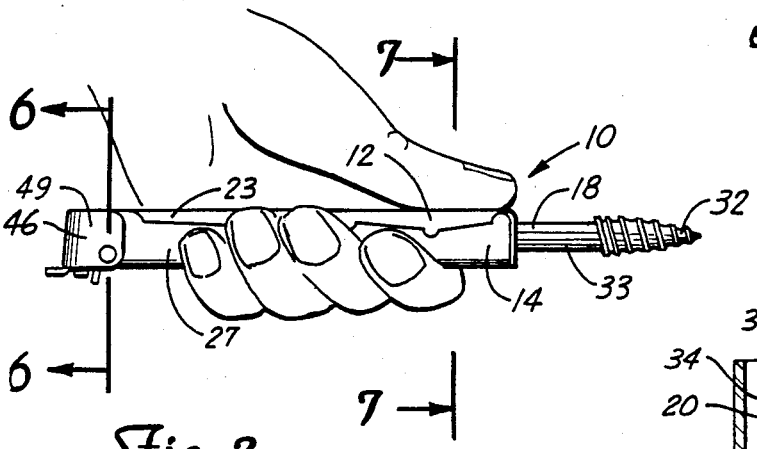
Fig. 3
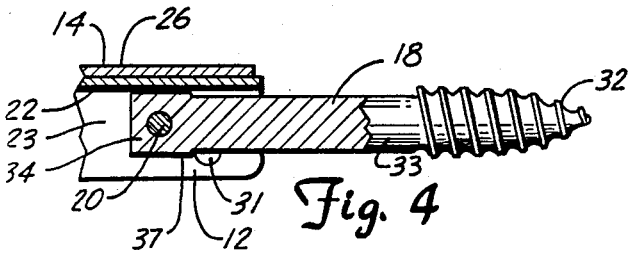
Fig. 4
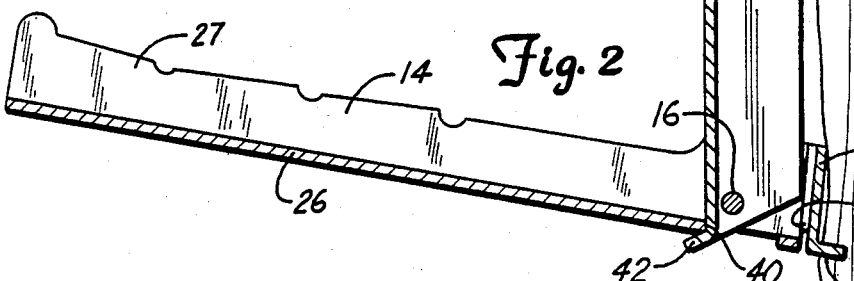
Fig. 2
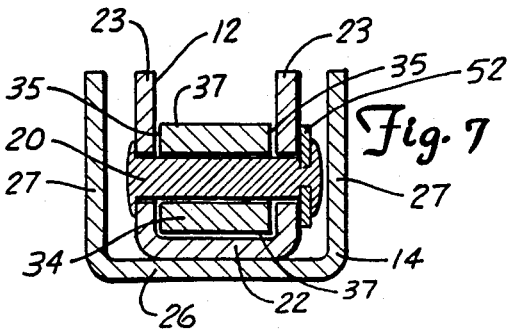
Fig. 7
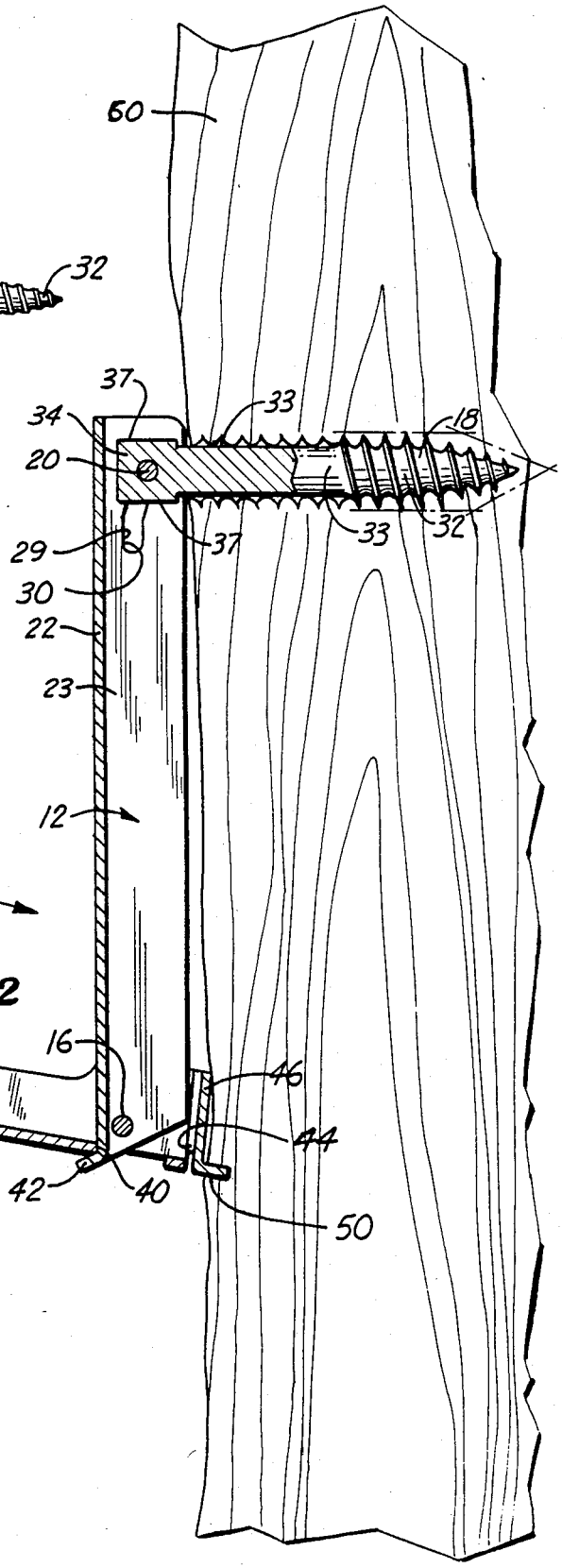

FOLDING PORTABLE TREE STEP

BACKGROUND OF THE INVENTION

1. Field of the Invention.

This invention relates to a portable tree step which can be rapidly fastened into a tree, just as rapidly removed and which can be folded to be easily stored and carried by an outdoorsman.

2. Description of the Prior Art.

I developed the first known portable tree step in the early 1960's, and obtained on it U.S. Pat. No. 3,298,459 granted to Bergsten in June of 1967. It was a rigid metallic crank-like structure including a large wood screw integral with and extending outwardly from the upper end of an elongated support leg, and an elongated step portion integral with and extending outwardly in an opposite direction from the lower end of the support leg. Portable steps made according to my invention were effective and were widely used, but they were found to be somewhat difficult to get started into the tree when the user was standing part way up the tree and did not have free use of both of his hands and arms for installing the step.

Others attempted to improve on my invention, and the following patents were issued:

| U.S. Pat. No. | Patentee | Granted |
|---|---|---|
| 3,380,697 | Melcher | April 1968 |
| 3,498,409 | Meyer | March 1970 |
| 4,413,706 | Michael | November 1983 |

The patent to Michael discloses a tree step having a partly channel-shape central leg 15, with the channel legs of the central leg extending out beyond the channel portion and with a straight pivot pin receiving slot being provided in each of those channel legs. A step 14 is connected to a lower end portion of the central leg by a pivot pin in such a manner that the step can be moved from a working position at 90° to the central leg to a storage position in nesting relationship to the central leg. When nested together, the open side of the step and central leg channels face in opposite directions. A tapered wood screw 16 is mounted on a screw pivot pin which slides in the pivot pin receiving slots of the central leg, and the screw can move from encompassed relation between the nested central leg and foot, to an extended position 180° from its nested position, and to a working position 270° from its original nesting position. By positioning the screw in its extended position and sliding it back so that the screw pivot pin is in the "lower end" end of the pin receiving slots, the first few threads of the screw can be driven into a tree, and the nested foot and central leg can be rotated to start the screw into holding position in the wood.

The web of the channel of the central leg 12 is said to keep the screw from moving out of aligned relationship with respect to the nested central leg and foot when the user has "slammed" the screw into the tree and has begun to rotate the nested central leg and foot to get the threads started into the tree. A difficulty with this structure, however, is best understood by examining FIGS. 5 and 7 of the Michael patent. As clearly seen in dotted lines in FIG. 7, the shank portion shown at 26 is spaced from the upper dotted lines delineating the channel web portion of the leg. The dotted lead line from the numeral 32 rests almost on the dotted line indicating the top of that web. The spaced-apart relationship of shank 26 from the channel web of the central leg 12 is also clearly seen in FIG. 5.

It has been found that the screw 16 will tend to flop back and fourth until the shank 26 contacts the end of the web either at the end of the shank or at the end of the "notch or space 32" which represents the end of the web.

The Michael structure also has a design problem in that the screw threads are tapered from beginning to end and because the diameter of the screw shank portion 26 is the same as the maximum diameter of the last of the screw thread. Because of this, after the screw is started into the tree, and the leg 12 is moved away from the screw to allow it to be put at right angles to the screw to help turn the screw, every turn of the screw requires far more force than the last. This will be understood from FIGS. 1 and 6 of Michael. More of the screw has to be forced at a greater and greater diameter as it is moved into the tree. Therefore, what may have been relatively easy at the beginning gets harder and harder as the screw is forced into the tree until at last, the cylindrical shank 26 is beginning to be drawn into the tree. Because this shank is of the same diameter as the largest diameter of the screw threads themselves, the forcing of this shank into screwed hole must enlarge the hole left by the screw threads up to the diameter of the shank. In order that the leg 12 is firmly situated against the tree as seen in FIG. 1, at least one or two revolutions of the screw after the shank 26 is in the hole will become necessary.

A further problem is that all of the torque on the screw to move it into and out of the tree must be transmitted through the pivot pin 24; and after a relatively small number of installations and removals of the tree step, the tendency of the pivot pin 24 to become bent or to fail is plainly evident.

Also, because the threads are tapered, if at any time and for any reason the screw starts to pull out of the wood, every outward movement will lessen the contact of the screw threads with the wood, and the failure will be sudden and extremely dangerous for anyone standing on or stepping on the step. This kind of failure can easily develop should the user apply more force than necessary on the last turn as the upper part of the leg 12 grinds and rotates into the bark of the tree. In order for the step to be positioned as seen in FIG. 1, the screw must be rotated until the leg 12 can hang vertically. In the case of the Michael tree step, because of the tapered screw, the step should always be forced in a counterclockwise direction as seen from the left in FIG. 1 and the screw always moved in tighter in order to arrive at a vertical positioning of the leg 12. This movement may cause the wooden "threads" formed by the screw to be "stripped." Any movement in reverse direction to align the leg to vertical position would back the tapered screw threads out of the wood so they will no longer have even the original full holding power to prevent a disastrous failure of the step.

As best seen in FIGS. 1, 3 and 4 of the Michael patent, all of the weight of a hunter or other user of the tree step on the step 14 is transmitted through a step pivot pin 20 and through leg 12 to the wood screw 16. Any deformation, bending or other failure of the pivot pin 20 will result in the sudden depositing of the person standing on the step 14 on the ground or to whatever lies beneath the step.

To overcome the initial crudities of my first portable tree step and to overcome the difficulties with the prior art, I have developed the present folding portable tree step.

Neither I nor those in privity with me are aware of any prior art structure more pertinent than those listed and discussed above. We know of no prior art which anticipates the claims herein.

SUMMARY OF THE INVENTION

A folding portable tree step has an elongate, channel-shape support leg; a lag screw member pivotally and slidably mounted to an upper end portion of the support leg; and a channel-shape foot member pivotally mounted to a lower end portion of the support leg. The foot member is pivotal from a folded position in nesting relation to the support leg to working position about 90° from its folded position; and the lag screw member is pivotable from a folded position in parallel, nested relation between the channel legs of the support leg to an extended position parallel to its folded position but extending and pointing outwardly from the support leg. The working position of the folding portable tree step is with the lag screw member extending outwardly from the support leg at about 90° from the longitudinal axis of the support leg and with the foot member extending outwardly from the support leg with the longitudinal axis of the foot member being no greater than 90° from the longitudinal axis of the support leg.

To the prior art structure as set out above, the following improvements are presented.

The foot member is pivotally mounted to the support leg in such a manner that the channel webs of each are in adjacent facing relation with respect to the other and, therefore, the channels of both are open in the same direction when the foot member is in its folded position.

An upper end portion of the support leg is provided with a pair of mutually parallel cam-like guide slots each extending through one of its channel legs.

The lag screw member is pivotally and slidably mounted to the support leg on a lag screw pivot pin which extends through the lag screw member and which extends through the cam-like guide slots in the channel legs of the support leg. Each guide slot has a lower end portion in relatively close relation to the support leg channel web and an upper end portion spaced farther out from that web. The relationship of these parts is such that: (1) when the lag screw means is in its extended position and the lag screw pivot pin is in the lower end of the guide slots, the lag screw means is prevented by the support leg channel web from any pivotal movement out of that extended position, and (2) when the lag screw pivot pin is in the upper end of the guide slots, the lag screw means is far enough from the support leg web that it is free to pivot between its extended position, its working position and its folded position.

BRIEF DESCRIPTION OF THE DRAWINGS

FIG. 2 is a vertical sectional view of the tree step of FIG. 1 showing the working relationship of that step to a tree;

FIG. 3 is a side elevational view of a foot member and a support leg of the tree step of FIG. 1 in nested condition and with a lag screw member of the step in an extended position as it might be held by a user of the step in the act of moving the step rapidly toward and into the bark of a tree to begin its installation;

FIG. 4 is an enlarged fragmentary vertical sectional view of a portion of the tree step as seen in FIG. 3, but with the parts inverted;

FIG. 7 is an enlarged sectional view taken on the line 7—7 in FIG. 3;

DETAILED DESCRIPTION OF THE PREFERRED EMBODIMENTS

Figure 1:
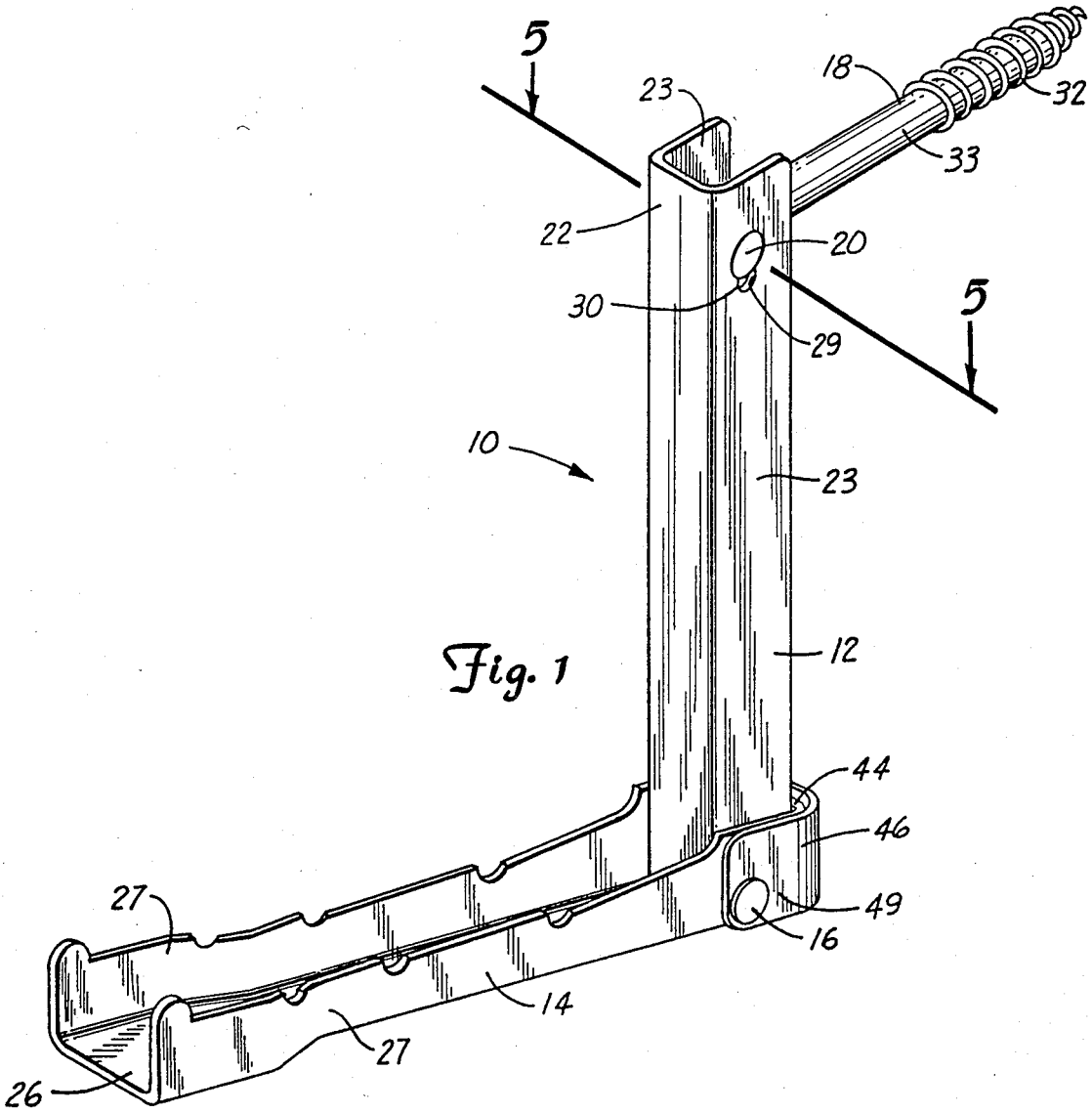
FIG. 1 is a perspective view of the portable tree step of the present invention with the parts in working position as if installed on a tree.

A portable tree step 10 of the present invention includes an elongate, channel-shape support leg 12 pivotably mounted at its lower end to a channel-shape foot member 14 through the instrumentality of a foot pivot pin 16. A lag screw member 18 is also part of the portable tree step and is slidably and pivotably mounted to an upper portion of the support leg 12 on a lag screw pivot pin 20.

The channel-shape support leg 12 is made up of a channel web 22 and a pair of mutually parallel channel legs 23,23. The channel-shape foot member 14 is made up of a channel web 26 and a pair of mutually parallel channel legs 27,27.

Figure 8:
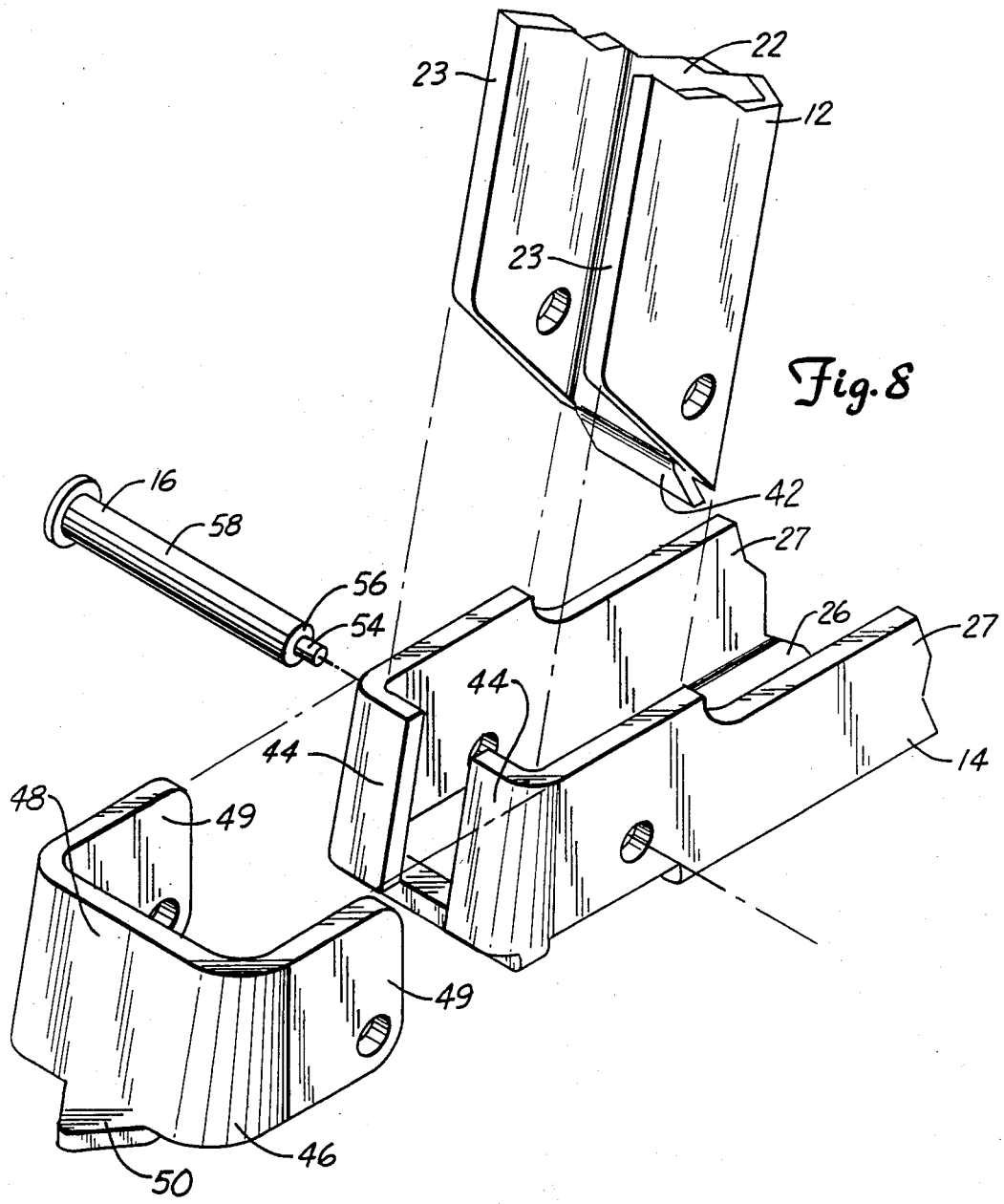
FIG. 8 is an exploded view of fragmentary portions of the tree step disclosing the relationship of the parts used to support the foot member on the support leg of the tree step.

Foot member 14 is pivotable on foot pivot pin 16 between a folded position with respect to the support leg 12 (FIGS. 3, 4, 6, 7 and 9) and a working position (FIGS. 1, 2 and 8). As seen in FIGS, 3, 4, 6, 7 and 9, when the foot member is in its folded position, the channels of it and of the support leg are both open in the same direction.

As described in detail below, the foot pivot pin 16 extends through provided openings in the channel legs 27,27 of the foot member 14 and of the support 12. This determines the movement of the foot member with respect to the support leg, but, when the foot member is in its working position, this pivot pin 16 does not have to carry the load on the foot member.

Upper portions of channel legs 27,27 in the support leg 12 are provided with a pair of mutually parallel, cam-like lag screw pivot pin guide slots 29,29 and the lag screw pivot pin 20 extends through an inner end portion or head 34 of the lag screw member 18 and slides and pivots in these guide slots 29,29. A lower end portion 30 of each of the guide slots is located in close proximity to the channel web 22 and an upper end portion 31 of each is spaced farther from the web 22.

The lag screw member 18 is made up of a lag screw portion 32, a cylindrical shank portion 33 and a head 34 which is square in transverse cross section. Lag screw pivot pin 20 extends through a central portion of two mutually parallel pivot pin receiving surfaces 35,35 of the head 34.

The lag screw portion 32 of screw member 18 includes a first relatively short leading tapered section and a second relatively longer following section having longitudinally extending cylindrical helical threads of uniform transverse dimensions.

The first tapered section of the lag screw portion can be of a longitudinal dimension and angle of taper only sufficient to allow the screw member 18 to be relatively easily drawn into the wood.

The second, following section can be long enough so that at least sufficient of its cylindrical helical threads will have enough holding power in the tree to withstand any longitudinal forces exerted on the screw member during the time it is installed in the tree and used as part of the tree step.

The cylindrical shank portion 33 of the screw member 18 will preferably have a transverse diameter no greater than the root diameter of the threads in the second, following section of the lag screw portion 32 of the screw member.

Figure 9:
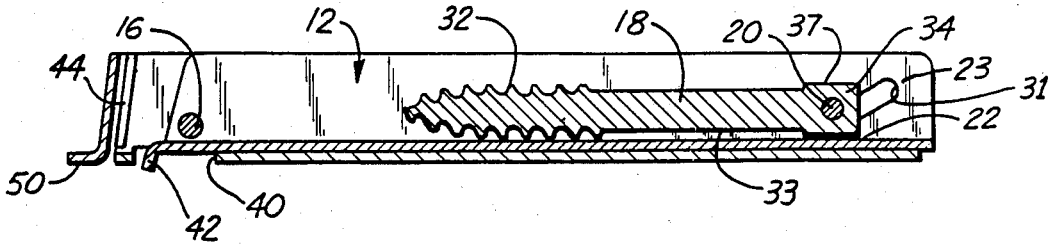
FIG. 9 is a vertical sectional view of the nested and folded tree step as seen in FIG. 3, but with the lag screw member in its nested or folded position.

The lag screw member 18 can move from an extended position (FIGS. 3, 4 and 7), through a working position (FIGS. 1, 2, 5, and 8) to a nested or stored position (FIG. 9).

When the lag screw member 18 is in either its extended or its folded position, and the lag screw pivot pin 20 is in the lower end portion 30 of the guide slots 29,29, one or the other of a pair of mutually parallel web contacting surfaces 37,37 of the head 34 lies in contact with the support leg channel web 22. This prevents the lag screw member 18 from having pivotable movement about its pivot pin 20 when in either one of these positions. This is of particular importance when the lag screw member is in its extended position and is being used as seen in FIG. 3 to be initially stabbed or slammed into a tree at the point on the tree where the portable tree step is to be installed.

Also, when the entire portable tree step is in its folded, nested position, and is stored in a position such that the lag screw pivot pin will stay in the lower end portions 30 of the guide slots 29,29, this relationship of one of the web contacting surfaces 37 to the web 22 will prevent the lag screw member 18 from rattling (when carried on the person of a hunter, for example) or from chattering (when being carried in a vehicle over the road, for example).

In order to eliminate or at least very substantially reduce the shear loading on foot pivot pin 16, and in order to at least somewhat reduce the shear forces carried by the lag screw pivot pin 20 when the portable tree step 10 is in its working position and condition, the special structure detailed in the exploded view of FIG. 8 has been incorporated into the tree step. As perhaps best seen in FIG. 2, a rectangular portion of the channel web 26 of the foot member 14 has been removed to provide that channel web 26 with a transversely extending foot rotation stop surface 40. This surface shows most clearly in FIG. 9. To ensure positive engagement between the foot member 14 and the support leg 12, an extended portion of the channel web 22 of the support leg has been bent outwardly from the channel legs 27,27 to form a foot rotation stop flange 42. This positioning of the parts is clearly seen in FIG. 2.

In order to relieve foot pivot pin 16 from having to transmit the vertical load of a person standing on foot member 14, the inner ends of the channel legs 27,27 have been bent flanges 44,44. The positioning of these flanges 44 can be most clearly seen in FIG. 6.

As seen in FIG. 2, the primary vertical component of downward thrust provided by the weight of the person standing on the foot member 14 is resisted by the channel web 22 including the foot rotation stop flange 42, while the tendency of the foot member 14 to pivot about the contact point between stop surface 40 and stop flange 42 is resisted by the contact between the support leg channel leg stop flanges 44,44 of the foot member 14 and the channel legs 23,23 of the support leg 12.

To reinforce the support leg channel leg stop flanges 44,44, and to take some of the vertical component of thrust being exerted on the support leg 12, a reinforcing clip 46 has been incorporated into the structure. This clip includes a base member 48 and a pair of mutually parallel arms 49,49, extending at right angles from the base member. These arms are provided with appropriate openings to receive the foot pivot pin 16. When the clip 46 is assembled with the support leg 12 and foot member 14 as perhaps best seen in FIGS. 1 and 2, the base member 48 lies in contacting supportive relationship to the support leg channel leg stop flanges 44,44 of the foot member 14.

A pointed, outwardly extending tang 50 is constituted as an integral projection off of the bottom of the base member 48 of the clip 46, and serves to absorb some of the component of vertical force to which the support leg 12 is subjected when the tree step is in use. Any force absorbed by the tang 50 is force that does not have to be carried in shear by the lag screw pivot pin 20.

A feature of the portable tree step 10 of the present invention is the free pivoting action of the lag screw member 18 and the foot member 14 with respect to the support leg 12. In the form of the invention as shown, this has been achieved by constituting the pivot pins 16 and 20 as rivets which are in the nature of shoulder bolts.

Figure 5:
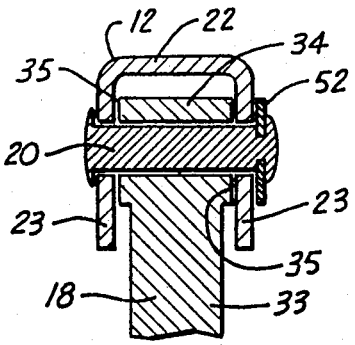
FIG. 5 is an enlarged horizontal sectional view taken on the line 5—5 in FIG. 1.

Specifically, first referring to FIGS. 5 and 7, the lag screw pivot pin or rivet 20 is held in place by a pivot pin washer 52. The rivet 20, before it was upset to permanently fasten washer 52 in place, had a narrowed neck over which washer 52 fit to rest on a rivet shoulder which was situated from the head of the rivet precisely the desired required distance from the outer surfaces of the support leg channel legs 23,23. Then, when the narrowed rivet stem was deformed to take the position as seen in FIGS. 5 and 7, the rivet/pivot pin 20 and the lag screw pivot pin washer 52 were firmly in place on the support leg 12, but the support leg 12 had not in any way been moved closer to the head 34, so the lag screw member could still freely pivot with respect to the support leg.

Figure 6:
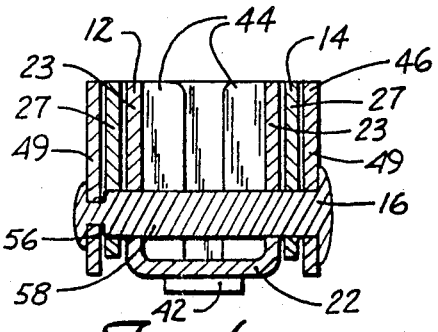
FIG. 6 is an enlarged sectional view taken on the line 6—6 in FIG. 3.

Similarly, as seen in FIGS. 6 and 8, the foot pivot pin or rivet 16 has a narrowed rivet forming stem 54 extending from a rivet shoulder 56 which defines an elongate cylindrical pivot pin portion 58 of pin 16. As seen in FIG. 6, the distance between this shoulder 56 and the original head on the rivet is such that the interior surfaces of the channel legs 27,27 of the foot member 14 are maintained at a distance such that these channel legs will never bind against the channel legs 23,23 of the support leg 12. This is accomplished by providing a smaller pivot pin receiving opening in the left channel leg 27 than in the right channel leg 27 in FIG. 6, this smaller opening being the same as the diameter of the narrowed rivet forming stem 54.

In use, the portable tree step 10 of the invention may be grasped, for example, as seen in FIG. 3 and stabbed or slammed into a tree 60 to start at least the tapered portion of the threads of the lag screw portion 32 into the wood. The tree step can then be rotated in a clockwise direction at least until the point where the forces required make it uncomfortable, difficult or impossible to continue. At that point, the nested and mutually folded support leg 12 and foot member 14 can be moved away from the tree forcing the pivot pin 20 to move from the lower end portion 30 to the upper end portion 31 of the guide slots 29,29. This places the head 34 of the lag screw member 18 in clearing relation to the web 22 of the support leg, and the support leg can be moved to a position at right angles to the lag screw member. Rotation of lag screw member 18 in clockwise direction can be continued. This can be aided by moving the foot member 14 from its folded position to its working position, and it can be used as a crank handle to speed up insertion the lag screw member 18 clear into the tree until the top portion of the support leg 12 comes in contact with the tree.

It is to be noted that the maximum forces needed to accomplish this movement of the lag screw into any particular tree 60 are determined by the number, size and shape of tapered screw threads in the first section of the lag screw portion 32 and by the number of the cylindrical helical screw threads which are present in the second section of that lag screw portion. Since the diameter of the cylindrical shank portion 33 is no greater than the diameter of the root portion of the threads, no additional amount of force is needed to move the lag screw member 18 into the tree from the point where all the screw threads are first "buried", until the parts rest as seen in FIG. 2.

Should it be necessary to rotate the screw member and the support leg in a counterclockwise or clockwise direction in order to bring the support leg into a vertical position, none of the holding power of the cylindrical helical screw threads will be lost. The holding power of the tapered threads is not a significant factor and was not relied on in the design of the tree step 10.

Once the lag screw member is firmly positioned in the tree, and the support leg is placed in a vertical position, the foot member 14 will be forceably moved into its working position thereby forcing the tang 50 into the tree 60 to position it so that there is no tendency for the support leg 12 to rotate out of its vertical alignment, and so that any deflection of the cylindrical shank 33 of screw member 18 when the step is under load will be at least partially borne by the tang 50.

As perhaps best seen in FIGS. 2 and 5, when the support leg 12 is moved to its working position at right angles to the lag screw member 18, the pair of mutually parallel pivot pin receiving surfaces 35,35 of screw member head 34 rest in contact with the inner surfaces of the support leg channel legs 23,23 so that in using movement of the support leg 12 to rotate the lag screw member 18 into the tree 60, it is not the lag screw pivot pin 20 which transmits the force of rotation of the leg 12 to the screw member 18, but rather the channel legs 23,23 of the support leg acting upon the pivot pin receiving surfaces 35,35 of the head 34 of the screw member 18.

When the foldable portable tree step 10 has served its purpose, and is to be removed from the tree, it is to be expected that it may initially take some extraordinary force to break the hold of the tree on the screw threads. This extra force is again administered by moving the foot member and the support leg to tend to rotate the screw member in counterclockwise direction. Here again, it is the channel legs 23,23 of the support leg which exert the primary rotational forces on the head of the screw member, and not the lag screw pivot pin 20.

Throughout the drawings, and particularly in FIGS. 4, 5, 6, 7 and 9, the clearance between the parts has been slightly exaggerated for clarity of illustration.

The angle of the foot member 14 with respect to the support leg 12 when in its working position can be anything up to 90° with respect to the longitudinal axis of the leg 12. However, something less than 90° is shown. This tends to ensure that the user standing on the foot 14 will not have any tendency to slide off of the foot. Also, the structure as shown will provide more positive locking and holding power due to the interaction between foot rotation stop surface 40 and foot rotation stop flange 42 and between support leg channel stop flanges 44 of foot member 14 and channel legs 23,23 of support leg 12.

The protruberance at the left end of the foot member 14 as seen in FIG. 2 and the cusp-shape depressions in the upper surfaces of the channel legs 27,27 of the foot member additionally increase the stability of a person whose foot is on the tree step.

Although the present invention has been described with reference to preferred embodiments, workers skilled in the art will recognize that changes may be made in form and detail without departing from the spirit and scope of the invention.

What is claimed is:

1. A folding portable tree step having;

a. an elongate, channel-shape support leg;

b. a lag screw member pivotally and slidably mounted to an upper end portion of the support leg to have a working position extending outwardly from the support leg at about 90° from the longitudinal axis of the support leg; and c. a channel-shape foot member pivotally mounted to a lower end portion of the support leg to have a working position extending outwardly from the support leg at about 90° from the axis of the support leg in an opposite direction from that of the lag screw member;

d. the foot member being pivotable from a folded position in parallel, nested relation between the channel legs of the support leg to an extended position parallel to its folded position but extending and pointing outwardly from the support leg;

the improvements wherein:

A. the foot member is pivotally mounted to the support leg in such a manner that the channel webs of each are in adjacent facing relation with the other and channels of both are open in the same direction when the foot member is in its folded position;

B. an upper end portion of the support leg is provided with a pair of mutually parallel cam-like guide slots each extending through one of its channel legs; and C. the lag screw member is pivotally and slidably mounted to the support leg on a lag screw pivot pin which extends through the lag screw member and which extends through the cam-like guide slots in the channel legs of the support leg;

D. each guide slot has a lower end portion in close relation to the support leg channel web and an upper end portion spaced farther from said web, the relationship of the parts being such that:

(1) when the lag screw means is in its extended position and the lag screw pivot pin is in the lower end of the guide slots, the lag screw means is prevented by the support leg channel web from any pivotal movement out of said extended position, and (2) when the lag screw pivot pin is in the upper end of the guide slots, the lag screw means is far enough from the support leg web that it is free to pivot between its extended position, its working position and its folded position.

2. The tree step of claim 1 wherein:

E. the lag screw member includes a head which is rectangular in transverse cross section and is partially defined by a pair of mutually parallel web contacting surfaces; and F. a first of said web contacting surfaces is parallel to and spaced from the axis of the lag screw pivot pin at a distance such that it is in contact with the support leg channel web when the lag screw pivot pin is in the lower end portion of the guide slots and the lag screw member is in its extended position, thus to prevent said pivotal movement of the lag screw member.

3. The tree step of claim 2 wherein:

G. a second of said web contacting surfaces is parallel to and spaced from said lag screw pivot pin axis at a distance such that it is in contact with said support leg channel web when lag screw member is in its folded position and the lag screw pivot pin is in the lower end portion of the guide slots.

4. The tree step of claim 2 wherein:

G. the head of the lag screw member is partially defined by a pair of pivot pin receiving surfaces through which the lag screw pivot pin is mounted, said pivot pin receiving surfaces being spaced apart approximately the same distance as the distance between facing inner surfaces of the support leg channel legs.

5. The tree step of claim 1 wherein:

E. the lower end portions of the support leg channel leg guide slots each include a run which is parallel to the support leg channel web.

6. The tree step of claim 1 wherein:

E. the lag screw member includes a head, a lag screw portion and a cylindrical shank portion; and F. the lag screw portion of the lag screw member includes a first tapered lead section having tapered helical screw threads and a second following section having substantially cylindrical helical screw threads.

7. The tree step of claim 6 wherein:

G. the cylindrical shank portion of the lag screw member has a diameter no greater than the root diameter of the screw threads in the second section of the lag screw portion of the lag screw member.

8. The tree step of claim 1 wherein:

E. means is provided for supporting the foot member in its working position so that its longitudinal axis does not pivot more than 90° away from the longitudinal axis of the support leg;

F. a portion of the foot member channel leg adjacent the foot pivot pin is cut away to provide a transversely extending foot rotation stop surface constituted as an edge of said web partially defining the cutout portion of the web; and G. a lowermost portion of the support leg channel web is constituted as a foot rotation stop flange which is situated to engage said foot rotation stop surface;

H. said stop flange and said stop surface forming at least part of said foot supporting means.

9. The tree step of claim 8 wherein:

I. support leg channel leg flange arresting means extends integrally from an end portion of the foot member adjacent the foot pivot pin in position to be in arresting, interferring relation with at least one of the ends of the support leg channel legs when the foot channel web stop surface engages the support leg web stop flange to become part of the foot supporting means.

10. The tree step of claim 9 wherein:

J. said foot supporting means is operative to support the foot member to have its longitudinal axis less than 90° from the axis of the support leg and so to support the foot member to carry loads placed on it without adding appreciably to the shear stress on the foot pivot pin.

* * * * *